United States Patent [19]

Anderson et al.

[11] 3,938,526

[45] Feb. 17, 1976

[54] ELECTRICAL ACUPUNCTURE NEEDLE HEATER

[76] Inventors: Weston A. Anderson, 763 La Para Ave., Palo Alto, Calif. 94306; Bruce E. Waller, 533 Pali Drive, Long Beach, Calif. 90805

[22] Filed: May 20, 1974

[21] Appl. No.: 471,649

[52] U.S. Cl. ..... 128/303.1; 128/329 A; 219/221

[51] Int. Cl.[2] ..... A61H 39/06

[58] Field of Search ..... 128/303.1, 2.1 C, 303.18, 128/329 A, 399, 401, 362, 404; 219/221, 229, 230, 236–241

[56] References Cited

UNITED STATES PATENTS

| | | | |
|---|---|---|---|
| 1,948,075 | 2/1934 | Miyaoka | 128/401 |
| 2,477,887 | 2/1949 | McMillan | 219/240 |
| 3,308,823 | 3/1967 | Peterson | 219/237 |
| 3,483,869 | 12/1969 | Hayhurst | 128/303.1 |
| 3,625,202 | 12/1971 | Oyoshirhara et al. | 128/2.1 C |
| 3,634,652 | 1/1972 | Shimizu et al. | 128/303.18 |
| 3,875,944 | 4/1975 | Toyama | 128/303.1 |

FOREIGN PATENTS OR APPLICATIONS

| | | | |
|---|---|---|---|
| 37-4190 | 3/1962 | Japan | 128/303.1 |

OTHER PUBLICATIONS

Capperauld et al., "Acupuncture Anesthesia in China", The Lancey, Nov. 25, 1972, pp. 1136–37.

*Primary Examiner*—Robert W. Michell
*Assistant Examiner*—Lee S. Cohen

[57] ABSTRACT

A method and apparatus for electrically heating an acupuncture needle that has been inserted into a subject is disclosed. An applicator unit contains an electrical heating element thermally coupled to an acupuncture needle and directly to the skin adjacent to the acupuncture needle. Regulation and control of the heat supplied by the applicator unit is achieved through the control of electrical power supplied to the heating element. Either temperature or power control can be selected, and temperature indication is provided. In use, after the acupuncture needle has been inserted through the subject's skin, the applicator unit is attached to the acupuncture needle and regulated electrical power is applied to produce controlled heat.

21 Claims, 3 Drawing Figures

ELECTRICAL ACUPUNCTURE NEEDLE HEATER

BACKGROUND OF THE INVENTION

The present invention relates to acupuncture treatment of patients and in particular to a method and apparatus for controlling the heating and monitoring the temperature of inserted acupuncture needles.

The procedure of applying heat to an inserted acupuncture needle, known as moxibustion, has been practiced in Eastern countries for centuries and recently has been introduced to Western countries in conjunction with the art and science of acupuncture. In part, this procedure is the production of heat supplied to the inserted acupuncture needle by attaching a small amount of dried leaves of Artemisia Vulgaris, or wormwood, to the handle of the inserted needle and lighting it, or holding the lighted end of a cigar-shaped roll of the dried leaves against the needle to heat it. This heating procedure is continued for from 5 to 20 minutes. It is claimed by the practitioners of this procedure that the needles heated in this fashion have an enhanced physiological action.

Acupuncture treatments using these prior art methods of heating inserted acupuncture needles sometimes produce burns caused by hot ashes falling on the patient. Uneven burning and poorly constituted burning materials cause uncontrolled variations of the applied heat, resulting in variations in treatment effectiveness.

SUMMARY OF THE INVENTION

The present invention permits the selection and application of controlled heat to inserted acupuncture needles to obtain optimum treatment conditions.

Briefly, heat is generated electrically and conducted to the site of an inserted acupuncture needle. Regulation and control of the heat is achieved through the control of the electrical power used to produce the heat. The rate of heat production can be selected and maintained by supplying a predetermined electrical power level to the heating element. Alternatively the temperature of the acupuncture needle is maintained by sensing the temperature at the site of the acupuncture needle and providing feedback information that will control the electrical power to maintain the temperature at the site of the acupuncture needle at the predetermined value. Indication of the acupuncture needle temperature is provided.

One object of the invention is to provide a safe and convenient means of supplying heat to an inserted acupuncture needle.

Another object of the invention is to supply an easily controllable heat to the inserted acupuncture needle for whatever length of time the operator desires.

A further object of the invention is to supply controlled heat to an inserted acupuncture needle wherein the temperature of the needle is maintained at a predetermined value.

Another object of the invention is to provide means for indicating the temperature of an inserted acupuncture needle.

It is a further object of this invention to provide a new and more modern method to heat an inserted acupuncture needle.

Another object of the invention is to supply controlled heat to the skin area adjacent to an inserted acupuncture needle.

Other objects, features, and advantages of the present invention will become apparent upon a perusal of the following specifications taken in connection with the accompanying drawings.

DESCRIPTION OF THE PREFERRED EMBODIMENTS

The disclosed invention enables the application of safe and easily controlled heat to inserted acupuncture needles, and to the skin area adjacent to the inserted needles.

Figure 1:
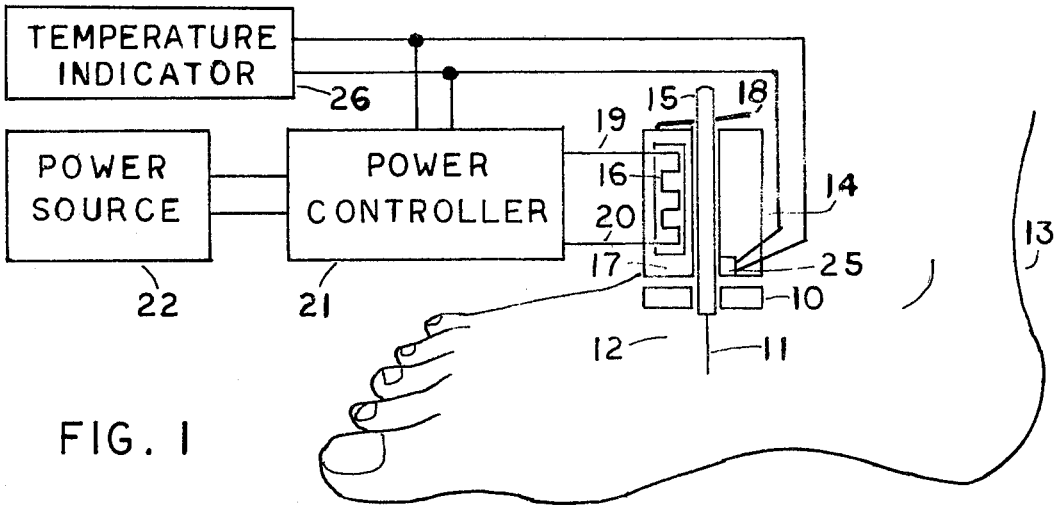
FIG. 1 is a block diagram which illustrates the principles of the invention.

FIG. 1 is a schematic diagram that illustrates the principle of operation of this invention. Acupuncture needle 11 is inserted through the skin 12 of animal tissue 13 shown for example as a human foot. Applicator 14 is positioned in close proximity to handle 15 of acupuncture needle 11. Heat applicator 14 contains an electrical heating element 16 and a heating element container made of a thermally conducting material 17. Heating element 16 may be composed of electrically resistive material such as Nichrome wire, or may be made of carbon or compressed graphite. Good electrical conductors such as copper wire can be used for heating element 16 provided the wire size is sufficiently small so that its resistance is high compared to that of the electrical wires 19 and 20 which couple heating element 16 to power controller 21. Thermally conducting material 17 conducts heat from heating element 16 to handle 15 of acupuncture needle 11. Heat is transmitted from handle 15, along acupuncture needle 11, through skin 12 into animal tissue 13. Bakelite and Teflon materials have been found to be suitable for the thermally conducting material 17 of the heating element container. Other materials that have moderate heat transporting properties and good electrical insulating properties are also suitable for conducting material 17.

Electrical power from power source 22 is regulated by power controller 21 and the regulated power is transmitted along wires 19 and 20 to heating element 16. The power level can be selected by the operator so that a predetermined power is supplied to heating element 16. Power source 22 may be batteries or a standard household power outlet.

Heat from electrical heating element 16 is also applied directly to skin 12 by the thermal pathway provided by thermal conducting material 17 and thermal conductor 10. Although not understood, it appears the heat applied to the skin adjacent to the inserted acupuncture needle enhances the physiological action of the heated inserted acupuncture needle for certain treatments. The material and thickness of thermal conductor 10 is chosen to regulate the ratio of the heat transmitted into the tissue by acupuncture needle 11 and the heat transmitted by thermal conductor 10 to skin 12. To increase the amount of heat transmitted directly to skin 12, thermal conductor 10 may be removed so that the heat is transmitted directly to skin 12 by the thermal conducting material 17. To decrease the amount of heat transmitted directly to skin 12, thermal conductor 10 may be increased in thickness and made of a material of poor thermal conductivity. Felt material of one-fourth inch thickness has relatively poor thermal conducting properties and is suitable for thermal conductor 10 when the direct thermal transfer to skin 12 is to be minimized. For intermediate values of heat transmission, thinner layers of felt material are suitable for thermal conductor 10.

Applicator 14 is fastened to needle handle 15 with clamp 18. Clamp 18 is a single wire of spring steel material that exerts a resilient force on the side of needle handle 15, holding it firmly against the thermally conducting material 17. The clamping arrangement and alternative clamping means are described below in connection with FIG. 2. Clamp 18 holds applicator 14 firmly in contact with thermal conductor 10 and holds thermal conductor 10 firmly in contact with skin 12 independent of the orientation of acupuncture needle 11 with respect to the vertical direction. If desired, applicator 14 may be clamped on handle 15 sufficiently far from needle 11 so that applicator 14 does not make mechanical contact with thermal conductor 10 or skin 12 to thereby obtain minimum direct thermal contact with skin 12. In operation, applicator 14 is supported and positioned by the inserted acupuncture needle 11.

Figure 2:
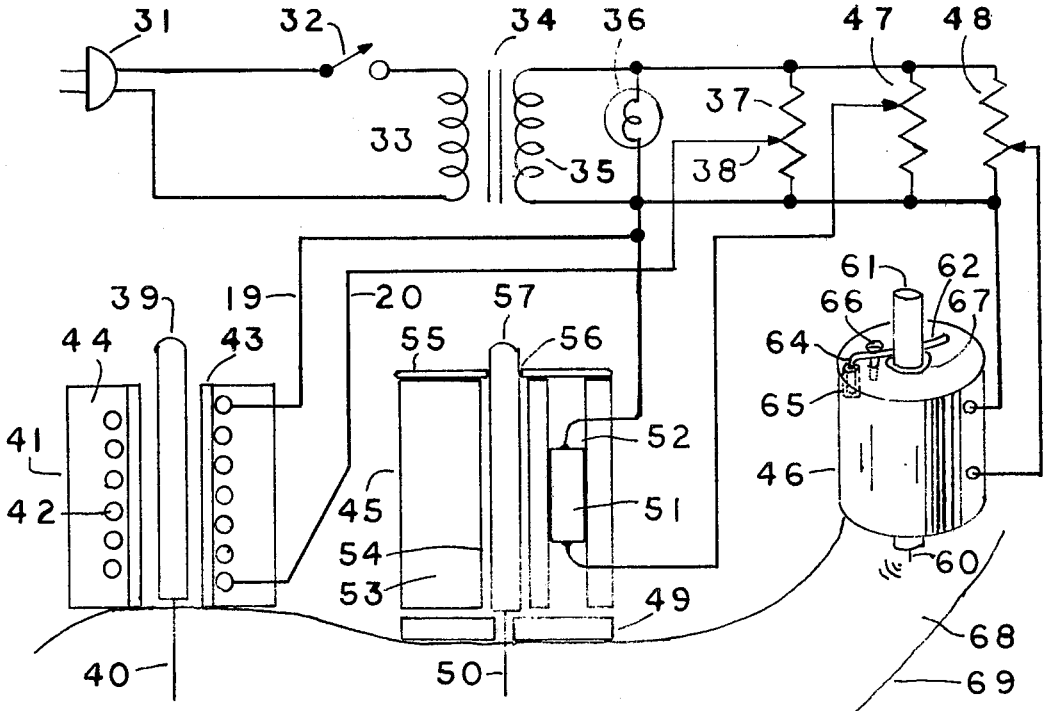
FIG. 2 is a circuit diagram of an embodiment of the invention wherein the heat generated is maintained at a predetermined power level.

FIG. 2 illustrates one embodiment of power controller 21 and heat applicator 14 of FIG. 1. Alternating current electrical power is supplied from a household power outlet through plug 31. Switch 32 controls the electrical power flow to the primary winding 33 of power transformer 34. The secondary winding 35 of power transformer 34 is coupled to the two electrical ends of potentiometer 37. One electrical end and the movable arm 38 of potentiometer 37 form output lines 19 and 20 respectively of the power controller. Pilot light 36 connected across transformer secondary 35 indicates the presence of power.

Power transformer 34 is designed to receive a primary voltage equal to the household line voltage, typically 117 volts in the United States. Secondary winding 35 typically has an output voltage of 2.5 volts and a current rating of 2 amperes or more. Potentiometer 37 typically has a power rating of 5 watts and a resistance of 5 ohms. Heat applicator 41 is comprised of electrical heating element 42 wound upon cylindrical tube 43 which in operation surrounds handle 39 of acupuncture needle 40. Heating element 42 is composed of approximately 10 inches of Nichrome wire, 0.012 inch in diameter, and having a resistance of approximately 3 ohms. Cylindrical tube 43 is composed of Teflon Plastic and has an inside diameter sufficiently large to slip over the handle of a standard acupuncture needle, typically from 0.04 to 0.10 inch in diameter. Heating element 42 is held in place by Epoxy material 44 which is in the form of a cylinder with an outside diameter in the range of 0.2 to 0.5 inch. Larger external diameters result in excessive heat loss and excessive weight. Typical length of cylindrical tube 43 and Epoxy material 44 is in the range of 0.2 to 1.2 inches. Weight considerations favor the smaller dimensions for length and diameter of heat applicator 41. It has been found that applicator weights over 5 grams places an undesirable thrust on an inserted acupuncture needle when it is not aligned near the vertical direction.

Heating element 42 is electrically connected to the power controller by wire leads 19 and 20. Provision is made for additional heat applicators 45 and 46 to be driven by the same power controller with separate control potentiometers 47 and 48, respectively.

Heat applicator 45 is constructed using a standard electronic circuit resistor 51, for example a carbon or metal film resistor as an electrical heating element. Resistor 51 has a resistance value of 3.9 ohms and a power rating of ¼ watt. Power levels greater than ¼ watt are readily dissipated by resistor 51 because the heat generated is quickly conducted away by main body 53. Resistor 51 fits snugly into hole 52 that has been drilled through main body 53 of heat applicator 45. Main body 53 may be composed of Bakelite material in the form of a right circular cylinder three-eighths inch in diameter and 0.8 inch in length. Bore 54 has a diameter of 0.09 inch and is designed to receive handle 57 of acupuncture needle 50.

Fixed to the main body 53 is a needle clamping means comprised of a rubber diaphragm 55 with hole 56 concentric with bore 54. In the absence of an acupuncture needle, hole 56 typically is 0.01 inch in diameter. In operation acupuncture needle handle 57 is forced through hole 56, the resilient diaphragm 55 clamping heat applicator 45 to acupuncture needle 50. The weight of applicator 45 is approximately 2 grams permitting it to be supported in any position by inserted acupuncture needle 50.

Heat applicator 46, drawn in perspective, further illustrates the clamping means of FIG. 1 for fixing heat applicator 46 to acupuncture needle handle 61. Spring steel wire 62, formed in the shape of the letter L is mounted with one end 64 in hole 65 and is held in place by screw 66. Spring wire 62 applies a resilient thrust on acupuncture needle handle 61 clamping it between spring wire 62 and bore 67.

In operation, switch 32 of FIG. 2 is turned off and plug 31 inserted into the household current supply. Sterilized acupuncture needles 40, 50, and 60 are inserted through skin 68 of animal tissue 69 by an acupuncturist. Heat applicators 41, 45, and 46 are slipped over the handles 39, 57, and 61 respectively of the inserted acupuncture needles. Potentiometers 37, 47, and 48 are set to obtain the desired power output and switch 32 is turned on. Should insufficient heat be generated at one acupuncture needle, for example needle 40, movable arm 38 of potentiometer 37 may be advanced to deliver more power to applicator 41. Should applicator 45 apply too much heat directly to the skin, felt pad 49 may be inserted to reduce the direct thermal contact with the skin.

An alternative embodiment of the invention provides temperature feedback to maintain a constant predetermined temperature at the site of the acupuncture needle. Temperature sensor 25 of FIG. 1 provides electrical signals to power controller 21 to hold the temperature at temperature sensor 25 at a predetermined value. In operation temperature sensor 25 and needle handle 15 are either in direct contact or alternatively thermal contact is provided through thermal conducting material 17. Temperature sensor 25 is a thermistor or alternatively one junction of a thermocouple. Temperature indicator 26 displays directly the temperature being sensed by temperature sensor 25.

Figure 3:
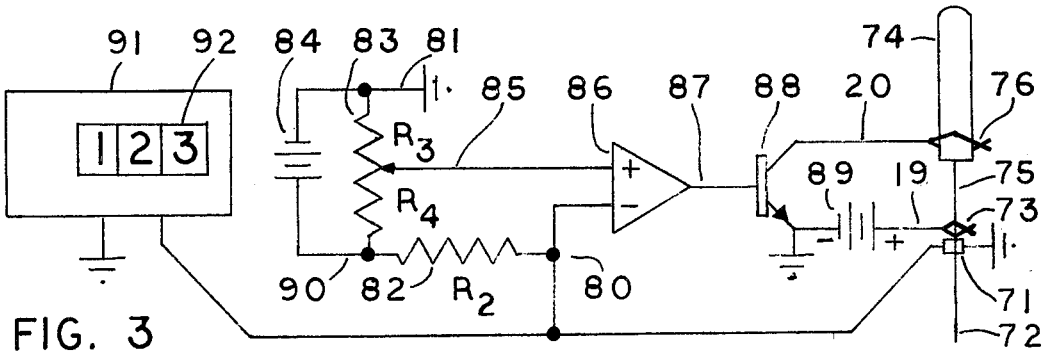
FIG. 3 is a circuit diagram of an embodiment of the invention wherein the temperature is maintained at a predetermined level.

FIG. 3 shows an alternate embodiment of power controller 21 and heat applicator 14 of FIG. 1. Thermistor temperature sensor 71 is placed in direct contact with acupuncture needle 72 for example by slipping it over the needle shaft so it is positioned next to lead attachment clip 73. Thermistor 71 is connected to one arm of an electrical bridge circuit comprised of resistor 82 and potentiometer 83. Power is supplied to the bridge by battery 84. The bridge output at terminals 80 and 85 is applied to the input terminals of amplifier 86. The amplifier output 87 is applied to the base of transistor 88. Transistor 88 controls the current flow from the direct current power source 89 to the acupuncture needle 72.

In this embodiment heat is generated by passing the current through a short section 75 of needle 72 to the handle 74. The needle 72 is typically 0.009 inch in diameter and made of stainless steel. Needle section 75 might typically be 0.25 inch long and have an electrical resistance of about 0.2 ohm. An electrical current of 2 amperes or less will supply sufficient heating power for many applications. Transistor 88 is an NPN power transistor, such as types 2N3055, 2N4913, or 2N5301. Power source 89 is capable of delivering 3 amperes or more of direct current power with a terminal voltage of approximately 10 volts. Amplifier 86 has a voltage gain typically in the range of 1 to 100 and has a high input impedance.

In practice the dial of potentiometer 83 is calibrated directly in units of temperature. This is readily done since thermistor resistance $R_t$ is a known function of temperature, generally with higher resistance values at higher temperature. With high loop gain the bridge operates near its balance condition:

$$\frac{r_t}{R_3} = \frac{R_2}{R_4}$$

where $R_3$ is the resistance of potentiometer 83 between points 85 and 81 and $R_4$ the resistance of potentiometer 83 between points 90 and 85. Temperature indicator 91 is a voltmeter with very high input impedance. The output reading has been calibrated to read directly in temperature units. The output indication may either be an analog meter reading or a digital display 92.

In operation, needle 72 and thermistor 71 are suitably sterilized. Thermistor 71 is slipped over needle 72 and the needle inserted into the animal tissue at the desired point. Lead 19 is then attached by clip 73 to the needle just above thermistor 71, and lead 20 is attached by clip 76 to handle 74 of needle 72. The potentiometer 83 is set to the desired temperature, generally between 120° and 150° Fahrenheit. As the needle is cooled by heat conduction to the animal tissue the resistance $R_t$ of thermistor 71 decreases causing the positive voltage at point 80 at the inverting input of amplifier 88 to decrease, and the output voltage at 87 to increase. The increased voltage on the base of transistor 88 causes it to conduct current more heavily and thereby increase the power supplied to needle section 75. The electrical power dissipated by needle section 75 increases its temperature, tending to raise it to the initially set temperature value. The application of the present invention does not substantially change the treatment applicability, efficacy, or treatment times of conventional moxibustion. These factors can be found in standard reference works for acupuncture and moxibustion, such as L. T. Tan, M. Y.-C. Tan, and I. Veith "Acupuncture Therapy, Current Chinese Practice" Temple University Press, 1973; Stephan Palos "The Chinese Art of Healing" Herder and Herder, Inc., 1971; and H. Kinoshita "Modern Acupuncture and Moxibustion, Series No. 1, Neuropathy", Ido-No Nippon sha, Yokosuka, Japan, 1973; distributed by Wright-Okada, Inc., San Francisco, Cal.

Since many changes will be apparent to persons skilled in the art, the invention is to be limited only as indicated by the scope of the appended claims and their legal equivalents.

We claim:

1. The method of heating an inserted acupuncture needle comprising the steps of:

thermally coupling said acupuncture needle to an electrical heating means, detachably coupling said electrical heating means to said acupuncture needle for support and positioning, of said electrical heating means by said needle, supplying electrical power to said electrical heating means thereby to generate heat, controlling said electrical power supplied to said electrical heating means to control the amount of heat generated.

2. The method of claim 1 wherein the step of controlling said electrical power comprises changing said electrical power in response to the temperature of said acupuncture needle.

3. The method of claim 1 including the step of indicating temperature of said acupuncture needle.

4. The method of claim 1 including the step of supplying heat to the skin adjacent to said inserted acupuncture needle.

5. The method of claim 1 including the step of thermally coupling said electrical heating means to the skin adjacent to said inserted acupuncture needle.

6. The method of claim 1 including the step of mechanically clamping said electrical heating means to said acupuncture needle.

7. The method of heating a plurality of inserted acupuncture needles comprising the steps of:

thermally coupling each said acupuncture needle to a separate electrical heating means, detachably supporting each of said electrical heating means by each of said acupuncture needles, separately supplying and controlling electrical power to each of said separate electrical heating means.

8. The method of claim 7 including the step of supplying heat to the skin adjacent to each of said inserted acupuncture needles.

9. An instrument for acupuncture therapy of animal tissue comprising:

an acupuncture needle, electrical heating means for thermally supplying heat to said acupuncture needle, means mechanically detachably coupling said electrical heating means to said acupuncture needle for supporting and positioning of said electrical heating means by said needle, and regulating means for regulating the amount of heat supplied by said heating means to said acupuncture needle for supply to said animal tissue.

10. The apparatus of claim 9 including a thermal coupling means for providing a thermal pathway between said acupuncture needle and said electrical heating means.

11. The apparatus of claim 10 wherein said electrical heating means comprises resistance wire wound upon an electrically insulating tube, and said thermal coupling means comprises said electrically insulating tube.

12. The apparatus of claim 10 wherein the combined weight of said electrical heating means and said thermal coupling means is less than 5 grams.

13. The apparatus of claim 10 including a second thermal coupling means providing a thermal pathway between said electrical heating means and the skin adjacent to said acupuncture needle.

14. The apparatus of claim 9 wherein said regulating means controls the electrical power supplied to said electrical heating means.

15. The apparatus of claim 14 wherein said regulating means comprises an electrical power transformer, a potentiometer having two electrical ends and a movable arm, said two ends being coupled to the secondary winding of said transformer, and said movable arm of said potentiometer and one of said ends of said potentiometer being coupled to said electrical heating means.

16. The apparatus of claim 9 including a temperature sensing means thermally coupled to said acupuncture needle, and means coupled to said temperature sensing means for indicating the temperature of said acupuncture needle.

17. The apparatus of claim 9 including a temperature sensing means thermally coupled to said acupuncture needle, said temperature sensor means electrically coupled to said regulating means thereby to maintain said acupuncture needle at a predetermined temperature.

18. The apparatus of claim 9 wherein said electrical heating means comprises an electronic circuit resistor.

19. The apparatus of claim 9 including means for supplying heat to the skin adjacent to said acupuncture needle.

20. The apparatus of claim 9 including clamping means mechanically fixing said electrical heating means to said acupuncture needle.

21. An instrument for acupuncture therapy of animal tissue comprising:

a plurality of acupuncture needles, a plurality of electrical heating means, each said electrical heating means thermally coupled to one of said acupuncture needles, supporting means mechanically detachably fixing each said electrical heating means to one of each said acupuncture needles for supporting and positioning each of said electrical heating means by one of each said needles, and a plurality of regulating means, each said regulating means controlling the electrical power supplied to one of said electrical heating means.

* * * * *